US005238373A

United States Patent [19]

Lew et al.

[11] Patent Number: 5,238,373

[45] Date of Patent: Aug. 24, 1993

[54] EXTENDING-RETRACTING VANE METER-MOTOR-PUMP

[76] Inventors: Hyok S. Lew; Yon K. Lew, both of 7890 Oak St., Arvada, Colo. 80005

[21] Appl. No.: 894,534

[22] Filed: Jun. 5, 1992

[51] Int. Cl.[5] ..... F04C 2/00

[52] U.S. Cl. ..... 418/137; 418/241; 73/260

[58] Field of Search ..... 418/24, 136, 137, 138; 73/260, 259

[56] References Cited

U.S. PATENT DOCUMENTS 4,646,568 3/1987 Lew ..... 73/260

FOREIGN PATENT DOCUMENTS 538977 6/1922 France ..... 418/138
803949 10/1936 France ..... 418/241
1217928 5/1960 France ..... 418/241
284473 4/1931 Italy ..... 418/241

*Primary Examiner*—Richard E. Gluck

[57] ABSTRACT

A positive displacement fluid handling apparatus comprises a hollow circular cylindrical vane guide with a plurality of slotted axial openings included in the cylindrical wall thereof and a plurality of vanes, wherein the hollow circular cylindrical vane guide is disposed rotatably within a circular cylindrical cavity included in the body of the apparatus in an eccentric and tangential relationship to the cylindrical wall of the cylindrical cavity and the plurality of vanes are disposed rotatably about the central axis of the circular cylindrical cavity and respectively engage and extend through the plurality of slotted axial openings included in the hollow circular cylindrical vane guide in such a way that the radial edges of the vanes slide on the circular cylindrical wall of the cylindrical cavity and, consequently, the motion of fluid moving from the inlet to the outlet of the apparatus through a crescent-shaped flow passage between the cylindrical wall of the cylindrical cavity and the hollow circular cylindrical vane guide is correlated to the rotating motion of the vanes and vice versa.

9 Claims, 2 Drawing Sheets

EXTENDING-RETRACTING VANE METER-MOTOR-PUMP

FIELD OF INVENTION

This invention relates to a positive displacement apparatus usable as a flowmeter, hydraulic or pneumatic motor or pump. A crescent-shaped flow passage provided by a space between the wall of a circular cylindrical cavity and a hollow circular cylindrical vane guide rotatably disposed within the circular cylindrical cavity in an eccentric and tangential relationship thereto provides a positively moving fluid pocket as a plurality of vanes rotatably supported by a shaft eccentrically disposed within the hollow circular cylindrical vane guide and respectively engaging and extending through a plurality of slotted axial openings included in the cylindrical wall of the vane guide provide a substantially leak-proof barrier moving from an inlet port to an outlet port.

BACKGROUND OF INVENTION

A positive displacement apparatus comprising a pair of combinations of a hollow circular cylindrical vane guide and a single vane rotatable about an axis eccentrically disposed within the vane guide, which vane engages and extends through a slotted axial opening included in the cylindrical wall of the hollow circular cylindrical vane guide, has been invented by one of the inventors of the present invention and disclosed in a U.S. patent application Ser. No. 846,698. The positive displacement apparatus comprising the pair of combinations of the vane guide and the single vane requires two cylindrical cavities respectively housing the pair of combinations of the vane guide and the single vane, and a gearing that couples the rotating motions of the two vanes respectively included in the pair of combinations of the vane guide and the single vane. A simpler version of the positive displacement apparatus employing the combination of the vane guide and the vanes can be constructed by employing a single combination of the hollow circular cylindrical vane guide and a plurality of vanes rotatably mounted on a shaft eccentrically disposed within the vane guide and radially extending through a plurality of slotted axial openings included in the cylindrical wall of the vane guide.

BRIEF SUMMARY OF INVENTION

The primary object of the present invention is to provide a positive displacement apparatus comprising a single hollow circular cylindrical vane guide rotatably disposed within a circular cylindrical cavity in an eccentric and substantially tangential relationship, and a plurality of vanes disposed rotatably about a common axis located within the vane guide in a relationship eccentric to the vane guide and concentric to the cylindrical cavity, wherein the plurality of vanes respectively engage and extend through a plurality of slotted axial openings included in the cylindrical wall of the vane guide in an axisymmetrically distributed arrangement and the radial edges of the plurality of vanes slide on the cylindrical wall of the cylindrical cavity.

Another object is to provide the positive displacement apparatus described in the primary object of the present invention, wherein each of the plurality of slotted axial openings included in the cylindrical wall of the vane guide has a pair of guide rollers disposed parallel to the central axis of the vane guide, which guide rollers guide the vane engaging and extending through the space therebetween in a frictionless relationship.

These and other object of the present invention will become clear as the description thereof progresses.

BRIEF DESCRIPTION OF FIGURES

The present invention may be described with a greater clarity and specificity by referring to the following figures.

DESCRIPTION OF ILLUSTRATED EMBODIMENTS

Figure 1:
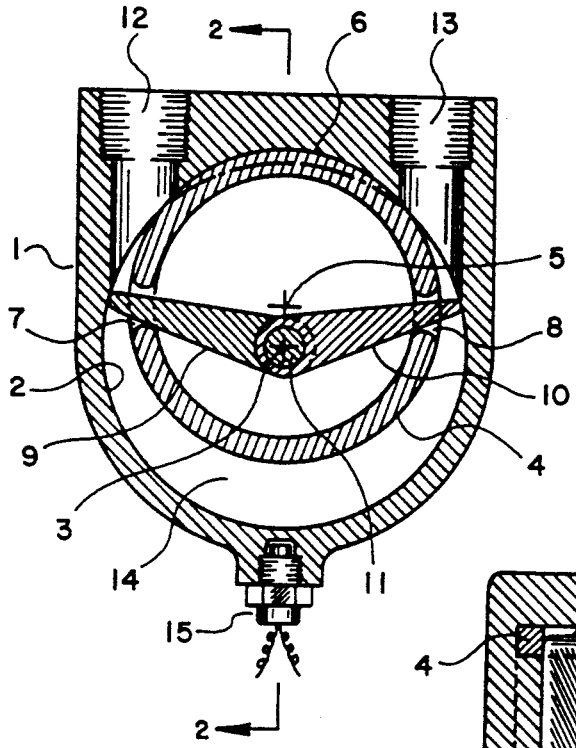
FIG. 1 illustrates a cross section of an embodiment of the present invention employing two vanes.

In FIG. 1 there is illustrated a cross section of an embodiment of the positive displacement apparatus of the present invention employing two vanes. The body 1 of the apparatus has a cylindrical cavity 2 with both ends closed and a substantial portion of the cylindrical wall coinciding with a first circular cylindrical surface with the central axis 3. A hollow circular cylindrical vane guide 4 having an exterior cylindrical surface substantially coinciding with a second circular cylindrical surface with the central axis 5 is disposed rotatably about the fixed central axis 5 within the cylindrical cavity 2 in a parallel eccentric and substantially tangential relationship to the first circular cylindrical surface with the central axis 3, wherein the exterior cylindrical surface of the vane guide 4 slightly extending across a portion of the first circular cylindrical surface with the central axis 3 is under a sliding contact with a portion of the cylindrical wall of the cylindrical cavity 2 over a section 6 thereof straddling the plane of symmetry passing through the two central axes 3 and 5. The hollow circular cylindrical vane guide 4 includes two slotted axial openings 7 and 8 included in the cylindrical wall thereof in an axysymmetric arrangement. A pair of vanes 9 and 10 are rotatably supported by a shaft 11 disposed coaxially to the central axis 3 of the first circular cylindrical surface substantially including the cylindrical wall of the cylindrical cavity 2, which pair of vanes 9 an 10 respectively engage and extend through the two slotted axial openings 7 and 8 included in the cylindrical wall of the vane guide 4. The radial edges of the two vanes 9 and 10 slide on the circular cylindrical portion of the cylindrical wall of the cylindrical cavity 2 during rotation thereof about the central axis 3. It is immediately recognized that the rotation of the vanes 9 and 10 about the central axis 3 rotates the vane guide 4 about the central axis 5, and vice versa. The width of the slotted axial openings 7 and 8, and the thickness of the vanes 9 and 10 may be selected in such a way that there is only a small clearance therebetween during all phases of rotating motion of the combination of the vanes 9 and 10 and the vane guide 4. An inlet port 12 and an outlet port 13 are respectively open to the two opposite extremities of of the crescent-shaped flow passage 14 provided by the space between the cylindrical wall of the cylindrical cavity 2 and the exterior cylindrical surface of the vane guide 4. A motion sensor 15 may be included to measure the rotating speed of the vanes or to count the number of rotations thereof. The shaft 11 may be supported by the body 1 rotatably or fixedly as the vanes 9 and 10 are rotatable independently about the shaft 11. The exterior cylindrical surface of the vane guide 4 may be of a continuous circular cylindrical surface as shown in the particular illustrative embodiment, or a substantially circular cylindrical surface including a series of parallel axial grooves or axial ridges. The interior cylindrical surface of the vane guide does not need to coincide with a circular cylindrical surface. It should be understood that, in order to be a truly positive displacement apparatus, at least one of the two vanes 9 and 10 extending out of the vane guide 4 and into the crescent-shaped flow passage 14 must be located between the inlet and outlet ports 12 and 13 at all instants, whereby the vane provides a substantially leak-proof barrier filling up the cross section of the crescent-shaped flow passage 14 and the fluid cannot flow through the crescent-shaped flow passage 14 without rotating the vane and vice versa. This condition requires that at least slightly more than one half of the circumference of the cylindrical cavity 2 must coincide with the first circular cylindrical surface with the central axis 3 in a section thereof intermediate the inlet and outlet ports 12 and 13. Of course, a quasi-positive displace apparatus results when the two ports 12 and 13 are moved towards the the midsection of the crescent-shaped flow passage 14 from the present locations shown in the particular illustrative embodiment.

Figure 2:
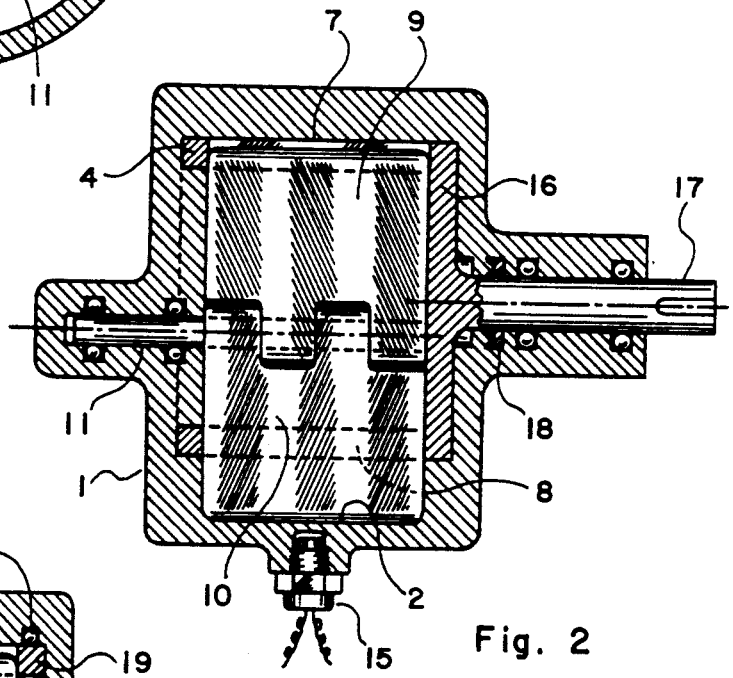
FIG. 2 illustrates another cross section of the embodiment shown in FIG. 1.

In FIG. 2 there is illustrated another cross section of the embodiment of the positive displacement apparatus shown in FIG. 1, which cross section taken along plane 2—2 as shown in FIG. 1 clearly shows the two vanes 9 and 10 now rotated to the plane of symmetry passing through the two central axes 3 and 5, which two vanes 9 and 10 are mounted on the shaft 11 in an arrangement similar to a piano-hinge so that the two vanes 9 and 10 can be rotated or pivoted independently about the shaft 11. In this particular illustrative embodiment, the shaft 11 us rotatably supported by the body at one extremity thereof, which shaft 11 may be affixed to the body 1 in an alternative embodiment, and the over-hanging portion of the shaft 11 extending into the cylindrical cavity 2 supports the vanes 9 and 10 in a free rotating relationship. The vane guide 4 with the two slotted axial openings 7 and 8 is supported by a flange 16 coaxially affixed to a power shaft 17 extending out of the body 1, which power shaft 17 transmits power to and from the vane guide 4 when the apparatus is applied as a pump or motor. A seal 18 prevents the fluid moving through the apparatus from leaking through the bore receiving the power shaft 17. When the apparatus is applied as a flowmeter, the power shaft 17 can be terminated within the body 1 and the outer end of the bore receiving the power shaft 17 can be plugged and, consequently, the seal 18 may be eliminated. It is readily realized that more than two vanes can be mounted on the shaft 11 by using the piano-hinge arrangement in such a way that each of the plurality of vanes is allowed to rotate or pivot independently from other vanes.

Figure 3:
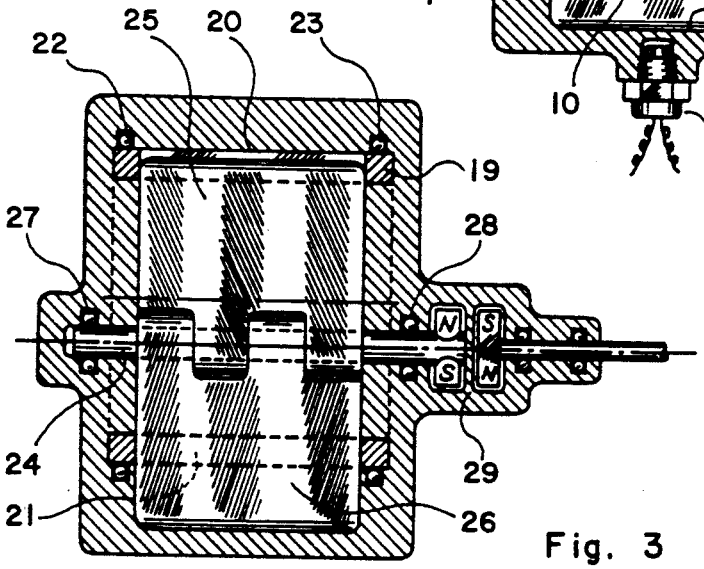
FIG. 3 illustrates a cross section of a modified version of the embodiment shown in FIG. 2.

In FIG. 3 there is illustrated a cross section of a modified version of the embodiment shown in FIG. 2. In this particular illustrative embodiment, the circular cylindrical vane guide 19 including a plurality of slotted axial openings 20, 21, etc. is rotatably supported at both extremities thereof by the body by means of a pair of bearings 22 and 23, while the shaft 24 rotatably supporting the plurality of vanes 25, 26 etc. is also rotatably supported at both extremities thereof by the body by means of a pair of bearings 27 and 28, which shaft 24 includes a magnetic rotary motion coupling 29 transmitting the rotating motion of the combination of the vanes and the vane guide to another shaft 30 driving a mechanical rotary motion counter that is not shown in the particular illustrative embodiment. It must be noticed that only one 25 of the plurality of vanes is nonrotatably mounted on the shaft 24 while other vanes are rotatably mounted on the shaft 24, which arrangement couples the rotating motion of the combination of the vanes and the vane guide to the shaft 24 without interfering with the rotating motion of the individual vanes. It is readily recognized that the shaft 24 can be extended out of the body whereby it functions as a power shaft transmitting power to or from the combination of the vanes and the vane guide.

Figure 4:
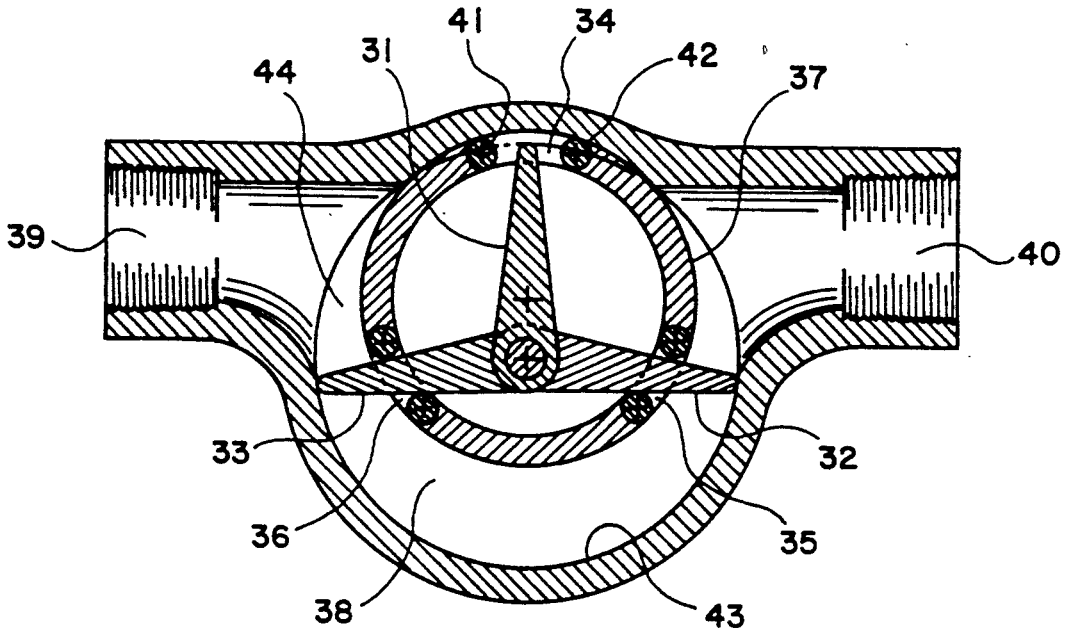
FIG. 4 illustrates a cross section of another embodiment of the present invention employing three vanes.

In FIG. 4 there is illustrated a cross section of another embodiment of the positive displacement apparatus of the present invention, that employs three vanes 31, 32 and 33 respectively engaging and extending through three slotted axial openings 34, 35 and 36 included in the cylindrical wall of the hollow circular cylindrical vane guide 37 in an axisymmetrically distributed arrangement. It is readily noticed that, as the number of the vanes increases, the circumferential angle including the circular cylindrical portion of the circumference of the cylindrical cavity decreases and, consequently, the crescent-shaped flow passage 38 connects the inlet port 39 to the outlet port 40 in less constricted and less curved arrangement, which improves the capacity and efficiency as well as the accuracy of the positive displacement apparatus. In order to further improve the operating efficiency as well as the operating life of the apparatus, a pair of guide rollers 41 and 42 are included in each of the plurality of slotted axial openings 34, 35, 36, etc. so that the vane engaging and extending through the space between the pair of guide rollers 41 and 42 is guided in a frictionless manner. These guide rollers may be included in the embodiments shown in FIGS. 1 and 5. It is noticed that, in the embodiment employing three vanes, the unbroken circular cylindrical portion 43 of the cylindrical wall of the cylindrical cavity 44 is slightly less than one half of the total circumference of the cylindrical cavity 44, which condition allows to dispose the inlet and outlet ports 39 and 40 in an in-line arrangement.

Figure 5:
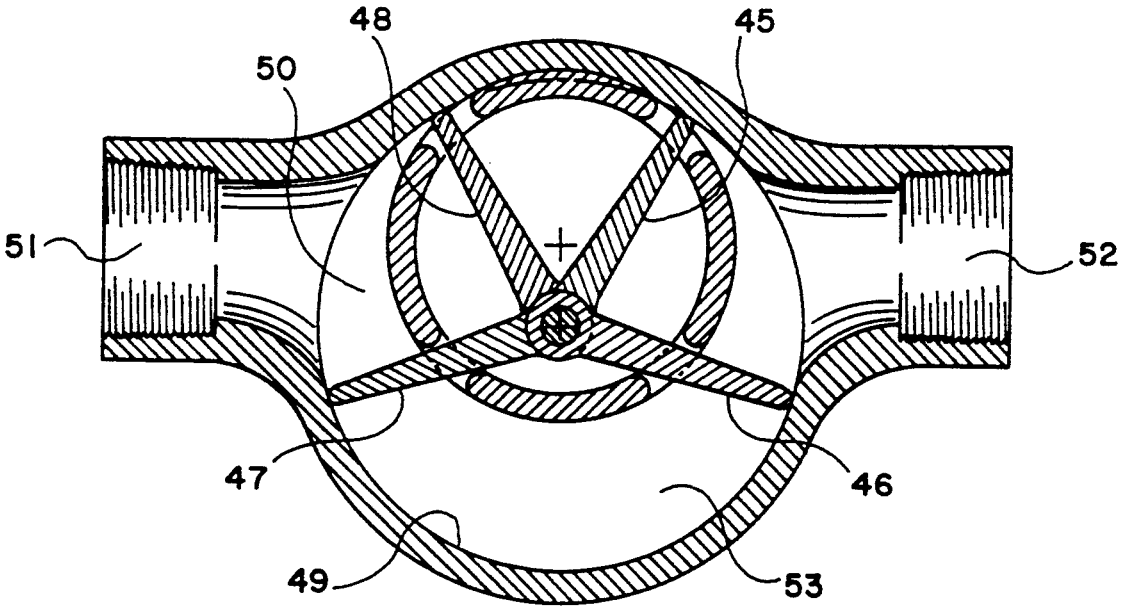
FIG. 5 illustrates a cross section of a further embodiment of the present invention employing four vanes.

In FIG. 5 there is illustrated a cross section of a further embodiment of the positive displacement apparatus of the present invention, that employs four vanes 45, 46, 47 and 48. As the unbroken circular cylindrical portion 49 of the cylindrical wall of the cylindrical cavity 50 is slightly greater than one third of the total circumference of the cylindrical cavity 50, the two ports 51 and 52 connected to one another by the crescent-shaped flow passage 53 provides an even more streamlined passage for the fluid moving through the positive displacement apparatus, which arrangement further improves the efficiency and accuracy of the apparatus. In general, a positive displacement apparatus of the present invention of small size should have a small number of vanes, e.g., two, three or four, while an apparatus of large size should have many vanes, e.g., five, six, seven or eight.

The most preferred embodiments of the present inventions are illustrated in FIGS. 4 and 5, which includes three or more vanes, which embodiments incorporate the following features of unique and ingenious nature: The inlet port 51 and the outlet port 52 are separated on one circumferential side of the vane guide by the cresent-shaped flow passage 53 encompassing an angular region about the axis of rotation of the vanes, that is approximately equal to the maximum angular separation between two adjacent vanes occuring during the rotation thereof about the axis of rotation, and on the other circumferential side of the vane guide by an angular portion of the outer cylindrical wall of the vane guide under a sliding contact with the inner wall of the cylindrical cavity 50 over an angular region abut the axis of rotation of the vanes, that is approximately equal to the minimum angular separation between tow adjacent vanes occuring during the rotation thereof about the axis of rotation. The thickness of the vanes 45, 46, 47, 48, etc. are tapered down in a monotonically decreasing relationship from the inner radial extremity adjacent to the axis of rotation thereof towards the outer radial extremity sliding on the circular cylindrical portion 49 of the cylindrical wall of the cylindrical cavity 50, in such a way that the vanes engages the slotted axial openings included in the hollow cylindrical vane guide in a close tolerance relationship when the vanes are located in an angular region including the crescent-shaped flow passage. The best result in the close tolerance engagement between the vanes and the slotted axial openings in the hollow cylindrical vane guide is obtained, when each of the two opposite edges of the slotted axial opening has a round cross section, as shown in FIG. 5, or includes a roller 41 or 42 as shown in FIG. 4.

While the principles of the present invention have now been made clear by the illustrative embodiments, there will be many modifications of the structures, arrangements, proportions, elements and materials, which are immediately obvious to those skilled in the art and particularly adapted to the particular working environments and operating conditions, in the practice of the invention without departing from those principles. It is not desired to limit the invention to the particular illustrative embodiments shown and described and accordingly, all suitable modifications and equivalents may be regarded as falling in the scope of the invention as defined by the claims which follow.

The embodiments of the invention, in which an exclusive property or privilege is claimed, are defined as follows:

1. An apparatus for executing a function related to fluid flow comprising in combination:

a) a body including a cylindrical cavity with closed ends, wherein at least a portion of a cylindrical wall of said cylindrical cavity substantially coincides with a first circular cylindrical surface with central axis located at a central portion of cross section of the cylindrical cavity, said cylindrical cavity including two ports respectively open to two opposite halves of the cylindrical cavity respectively including two opposite halves of said circular cylindrical portion of cylindrical wall of the cylindrical cavity;

b) a hollow cylindrical vane guide with an exterior cylindrical surface substantially coinciding with a second circular cylindrical surface having a diameter smaller than diameter of said first circular cylindrical surface disposed within the cylindrical cavity rotatably about central axis of said second circular cylindrical surface located eccentrically to the central axis of said first circular cylindrical surface on a reference plane including the central axis of said first circular cylindrical surface and radially extending through said circular cylindrical portion of cylindrical wall of the cylindrical cavity; wherein the exterior cylindrical surface of said hollow cylindrical vane guide is under a sliding contact with a portion of cylindrical wall of the cylindrical cavity located diametrically opposite to said circular cylindrical portion of cylindrical wall of the cylindrical cavity, and the cylindrical wall of said hollow vane guide includes a plurality of slotted axial openings extending therethrough in a distributed relationship following circumference thereof; and c) a plurality of radially extending vanes disposed rotatably about the central axis of said first circular cylindrical surface and respectively engaging and extending through said plurality of slotted axial openings included in the cylindrical wall of the hollow cylindrical vane guide in a relationship wherein radial edges of the plurality of vanes slides on said circular cylindrical portion of cylindrical wall of the cylindrical cavity and the plurality of vanes respectively engage the plurality of slotted axial openings at least in part during the rotating motions thereof about the central axis of said first circular cylindrical surface, wherein each of the plurality of vanes has a tapered geometry with thickness continuously decreasing from inner radial extremity adjacent to the axis of said first circular cylindrical surface to the radial edge thereof in a monotonically decreasing relationship providing a close tolerance engagement between the vane and each of the plurality of slotted axial openings engaged thereby located in an angular region about the axis of said first circular cylindrical surface intermediate said two port openings and radially bounded by said circular cylindrical portion of cylindrical surface of the cylindrical cavity.

2. An apparatus as defined in claim 1 wherein said combination includes mans for measuring rate of rotation of the plurality of vanes.

3. An apparatus as defined in claim 1 wherein said combination includes means for transmitting power to and from the combination of the hollow cylindrical vane guide and the plurality of vanes.

4. An apparatus as defined in claim 1 wherein said second circular cylindrical surface partially extends across a portion of said first circular cylindrical surface, wherein a portion of said second circular cylindrical surface located outside of said first circular cylindrical surface substantially coincides with the portion of cylindrical wall of the cylindrical cavity under sliding contact with the exterior cylindrical surface of the hollow cylindrical vane guide.

5. An apparatus as defined in claim 4 wherein said combination includes means for measuring rate of rotation of the plurality of vanes.

6. An apparatus as defined in claim 4 wherein said combination includes means for transmitting power to and from the combination of the hollow cylindrical vane guide and the plurality of vanes.

7. An apparatus as defined in claim 1 wherein each of the plurality of slotted axial openings included in the hollow cylindrical vane guide has a pair of guide rollers rotatably supported by the hollow cylindrical vane guide and respectively providing two opposite edges of the slotted axial openings, and respectively guiding two opposite faces of the vane engaging and extending through the slotted axial openings.

8. An apparatus as defined in claim 7 wherein said combination includes means for measuring rate of rotation of the plurality of vanes.

9. An apparatus as defined in claim 7 wherein said combination includes means for transmitting power to and from the combination of the hollow cylindrical vane guide and the plurality of vanes.

* * * * *